US006429825B1

(12) United States Patent
Martek

(10) Patent No.: US 6,429,825 B1
(45) Date of Patent: Aug. 6, 2002

(54) CAVITY SLOT ANTENNA

(75) Inventor: Gary A. Martek, Kent, WA (US)

(73) Assignee: Metawave Communications Corporation, Redmond, VA (US)

( * ) Notice: Subject to any disclaimer, the term of this patent is extended or adjusted under 35 U.S.C. 154(b) by 0 days.

(21) Appl. No.: 09/693,308

(22) Filed: Oct. 20, 2000

(51) Int. Cl.[7] ..... H01Q 13/10
(52) U.S. Cl. ..... 343/770; 343/771
(58) Field of Search ..... 343/770, 774, 343/771, 772, 776, 846, 806

(56) References Cited

U.S. PATENT DOCUMENTS

| | | | | |
|---|---|---|---|---|
| 2,807,018 A | * | 9/1957 | Woodward, Jr. | 343/770 |
| 4,005,431 A | * | 1/1977 | Hammarstrom | 343/771 |
| 4,243,990 A | * | 1/1981 | Nemit et al. | 343/771 |
| 5,028,930 A | * | 7/1991 | Evans | 342/373 |
| 5,579,019 A | * | 11/1996 | Uematsu et al. | 343/771 |
| 5,726,666 A | * | 3/1998 | Hoover et al. | 343/770 |
| 6,091,372 A | * | 7/2000 | Dienes | 343/770 |
| 6,178,333 B1 | | 1/2001 | Feuerstein et al. | 455/503 |
| 6,188,373 B1 | | 2/2001 | Martek | 343/893 |

OTHER PUBLICATIONS

U.S. patent application Ser. No. 09/213,640, Gary A. Martek, filed Dec. 17, 1998.
U.S. patent application Ser. No. 08/896,036, Gary Allen Marteck et al., filed Jul. 17, 1997.

* cited by examiner

*Primary Examiner*—Don Wong
*Assistant Examiner*—James Clinger
(74) *Attorney, Agent, or Firm*—Fulbright & Jaworski L.L.P.

(57) ABSTRACT

In one embodiment, the present invention provides an antenna array for transmitting one or more beams in a communication system. The antenna includes a cavity slot antenna array that is adapted to be operatively connected to a beam forming module (e.g., via a plurality of signal feed lines that are connected to radiating signal probes). The antenna array has one or more cavity slot columns adjacently fixed to one another with each of the one or more columns having at least one cavity slot antenna element for providing a radiating beam component. The combined cavity slot elements from the one or more columns define a cavity slot array for providing the one or more beams from the cavity slot beam components.

18 Claims, 6 Drawing Sheets

CAVITY SLOT ANTENNA

RELATED APPLICATIONS

The present invention is related to copending and commonly assigned U.S. patent application Ser. No. 09/213,640, entitled "Dual Mode Switched Beam Antenna" filed Dec. 17, 1998, copending and commonly assigned U.S. patent application Ser. No. 09/034,471 entitled "System and Method for Per Beam Elevation Scanning," filed Mar. 4, 1998, copending and commonly assigned U.S. patent application Ser. No. 08/896,036 entitled "Multiple Beam Planar Array With Parasitic Elements," filed Jul. 17, 1997, and copending and commonly assigned U.S. patent application Ser. No. 09/060,921 entitled "System and Method Providing Delays for CDMA Nulling," filed Apr. 15, 1998, the disclosures of which are hereby incorporated herein by reference.

TECHNICAL FIELD

The present invention relates generally to antenna arrays for multi-beam antenna systems. In particular, the present invention relates to a cavity slot antenna array for a multi-beam antenna in a communications system.

BACKGROUND

It is common to use a single antenna array to provide a radiation pattern, or beam, which is steerable. For example, steerable beams are often produced by a planar or panel array of antenna elements each excited by a signal having a predetermined phase differential so as to produce a composite radiation pattern having a predefined shape and direction. In order to steer this composite beam, the phase differential between the antenna elements is adjusted to affect the composite radiation pattern.

A multiple beam antenna array may be created, utilizing a planar or panel array described above, for example, through the use of predetermined sets of phase differentials, where each set of phase differential defines a beam of the multiple beam antenna. For example, an array adapted to provide multiple selectable antenna beams, each of which is steered a different predetermined amount from the broadside, may be provided using a panel array and matrix type beam forming networks, such as a Butler or hybrid matrix. The afore referenced application entitled "Dual Mode Switched Beam Antenna" describes an excellent scheme for providing such a multiple beam antenna system.

With such systems, it may be desirable to use antenna element arrays having antenna element columns with minimal inter spacing, such as inter-column spacing. Unfortunately, conventional antenna element arrays used in communications systems incorporate relatively bulky antenna elements (e.g., dipole elements) that each must be separately linked to a beam forming module. Such elements often consume excessive space, which makes it difficult to sufficiently reduce their spacing. In addition, with each element being separately linked to a beam forming module, excessive signal feed resources are required for supplying such linkage. Furthermore, it is tedious and costly to effectively mount each antenna element within the array chassis. For example, each element may have to be separately soldered to a grid chassis by a skilled technician. Thus, with conventional communication system antenna element arrays, it is difficult to implement multiple beam system methodologies.

Accordingly, what is needed in the art is an improved antenna element array for a multi-beam antenna in a communications system.

SUMMARY OF THE INVENTION

These and other objects, features and technical advantages are achieved with a cavity slot antenna array of the present invention. The present invention provides a cavity slot antenna array for a communications system such as a wireless network. In one embodiment, the antenna array generally includes a planar array of cavity slot antenna elements for transceiving one or more (e.g., steered) signal beams. This antenna is well-suited for implementing a phased array antenna such as a phased array antenna as described in U.S. patent application. Ser. No. 09/213,640, entitled Dual Mode Switched Beam Antenna, which has been incorporated by reference into this specification. The cavity slot elements can readily be configured (e.g., through aperture tapering and reduced inter-column spacing) for generating steered beams with minimal grating and reduced side lobes. In addition, once a desired configuration has been established, the cavity slot array may be efficiently manufactured—especially on a large scale or mass production basis.

In one embodiment, the present invention provides an antenna array for transmitting one or more beams in a communication system. The antenna includes a cavity slot antenna array that is adapted to be operatively connected to a beam forming module (e.g., via a plurality of signal feed lines that are connected to radiating signal probes). The antenna array has one or more cavity slot columns disposed in a predetermined relative position with respect to one another, such as adjacently fixed to one another with each of the one or more columns having at least one cavity slot antenna element for providing a radiating beam component. The combined cavity slot elements from the one or more columns define a cavity slot array for providing the one or more beams from the cavity slot beam components.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which.

DETAILED DESCRIPTION

Figure 1A:
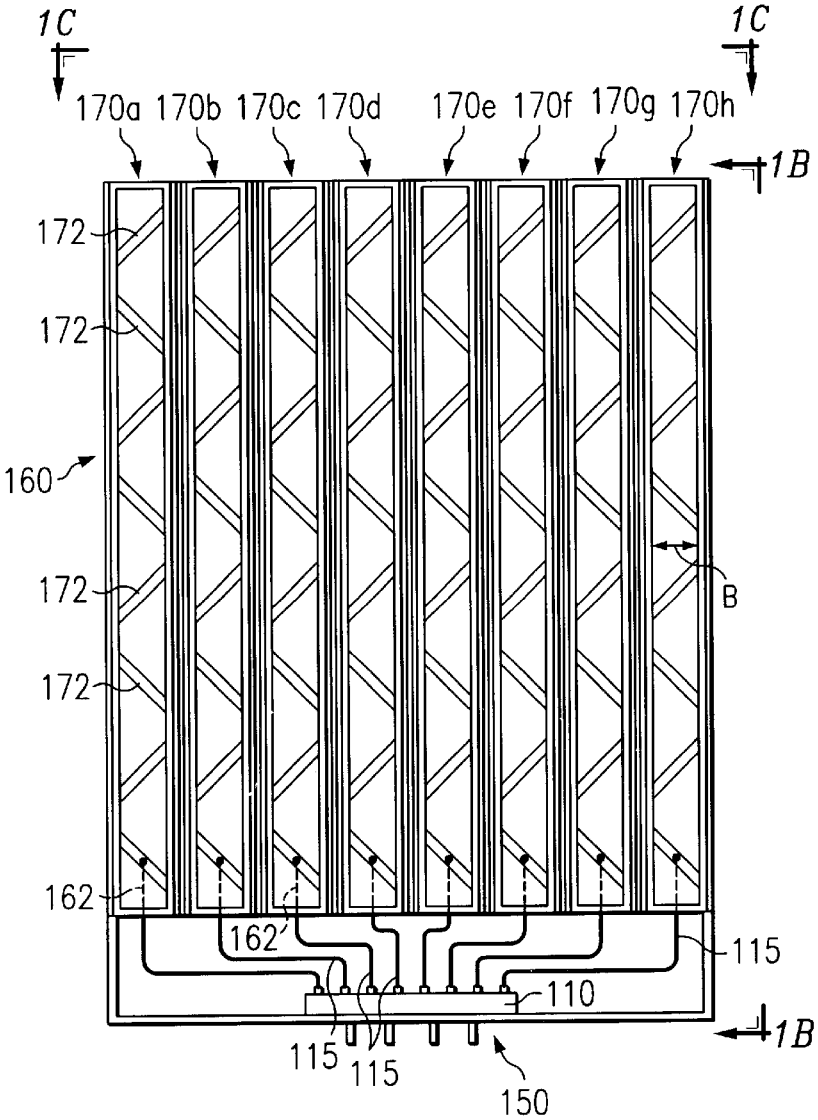
FIG. 1A shows a frontal view of one embodiment of a cavity slot antenna of the present invention.
Figure 1B:
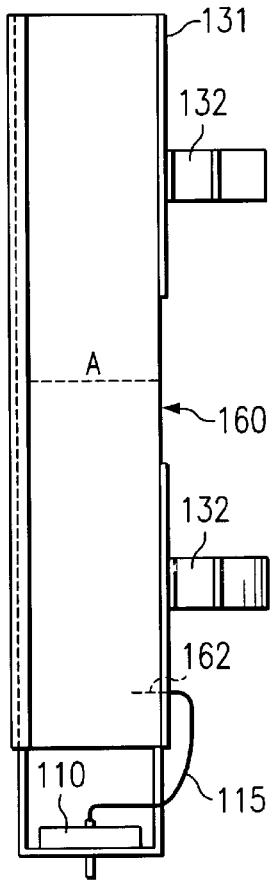
FIG. 1B shows an end view of the antenna of FIG. 1A taken along lines 1B—1B.
Figure 1C:
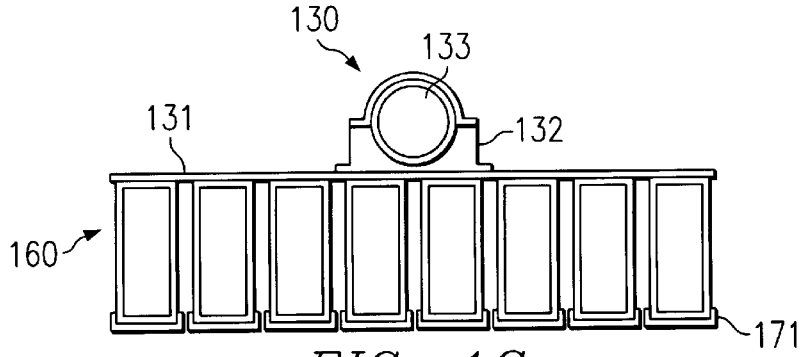
FIG. 1C shows a top view of the antenna of FIG. 1A taken along lines 1C—1C.

FIGS. 1A through 1C show one embodiment of a cavity slot antenna assembly 150 of the present invention. Antenna assembly 150 is preferably rigidly mounted (e.g., at a wireless transceiver station) via mounting assembly 130. In the depicted embodiment, antenna assembly 150 is operably connected to a beam forming module 110 via signal feed lines 115. The beam forming module could include any suitable circuitry such as a Butler or hybrid matrix for providing to the antenna assembly 150 one or more beam component signals in a phased antenna array system. Likewise, other signal feed circuitry well known in the art may be used, such as adaptive array feed systems providing dynamic adjustments of signal attributes such as phase and/or amplitude. Signal feed lines 115 may include any suitable device(s) for cooperating with antenna assembly 150 to provide to and/or receive from it the antenna signals. Such devices could include but are not limited to coaxial cables, micro-strip devices, air-line bus, and/or the like.

The depicted mounting assembly 130 generally includes a gang plate 131, mast clamps 132, and a mast 133. The mast 133 is secured to a desired base such as to the ground, a tower, or a building top. On one side, the gang plate 131 is rigidly fixed to a rear portion of the antenna assembly 150, and on its other side, it is adjustably fixed to the mast with the mast clamps 132. In this way, the antenna assembly 150 can be operably mounted at a desired location. Of course, mounting techniques other than that illustrated may be utilized according to the present invention, if desired. For example, the planer array of the illustrated embodiment is well suited for attachment to a flat surface, such as a wall of a building, without use of the mast mounting assembly shown.

In the depicted embodiment, antenna assembly 150 includes cavity slot element array 160 with one or more signal probes 162 for providing and/or receiving radiated signals to and from the element array 160. Probes 162 may be any form of transducer, such as probe (electric) or a loop (magnetic) as are well known in the art, (any of which are hereinafter referred to as a "probe") suitable for converting between radiated energy and a signal transmitted through signal feed lines 115. Cavity slot element array 160 comprises one or more cavity slot columns 170, which each have one or more slot pairs (antenna elements) 172 distributed there on. The slot pairs 172 each function as a dipole antenna element.

Also shown are radome slips 171 mounted at the front of the cavity slot assembly 160, such as may be used to prevent foreign objects from entering the slots of the array and/or to improve the aesthetic qualities of the antenna, such as through coloring and/or shaping to match an environment in which the array is deployed. It should be appreciated that the radome slips 171 are illustrated as separate radome portions for each cavity slot column. This embodiment allows for flexibility in spacing the columns as desired without a requirement for a plurality of radome structures for each such spacing. Additionally, the individual radome slips are advantageous in reducing the surface area of the radome for such purposes as wind load reduction. Of course, a continuous radome surface may be utilized, such as one presenting perforation at the positions between the cavity slot columns to reduce wind loading, if desired.

In the depicted embodiment, cavity slot array 160 is formed from eight contiguous 2.4 GHz cavity slot columns 170*a* through 170*h*. Of course, the present invention may be utilized with slot columns adapted for other frequency bands if desired. Each of these columns 170 comprises a slotted, vertically-disposed, rectangular wave-guide.

The preferred embodiment of the present invention uses in particular, a resonant rectangular wave guide with slots which are alternately inclined to the longitudinal axis of the wave-guide. The slot length is preferably the total length across the narrow dimension of the wave-guide and includes the two notches cut into the broad wall. In the illustrated embodiment this total length is roughly 0.5λ. The resonant cavity can be established for instance, by shorting one end of the wave-guide by a partition wall that completely encloses the end of the wave-guide. One quarter wavelength away from this short, a repeating pattern of inclined slots, spaced one half wave length from one another are cut into the wave guide wall. These slots will act as radiators by coupling out the TE10 mode energy contained as a standing wave within the guide cavity structure. The desired effect is to create a radiative column, which will ultimately create a vertically polarized radiation pattern that can be used as an array's element factor. Thus, by grouping a number of such column structures together, a planar array can be constructed.

The rectangular waveguides have a relatively narrow B surface and a relatively wide A surface. The columns of the preferred embodiment are disposed with the wider A surfaces facing each other. In turn, the cavity slot pairs 172 are cut out of the narrower B surfaces at the front of the array assembly 160. An important feature of the use of the narrow wall dimension of the preferred embodiment, is that the longitudinal axis of each wave guide column can be spaced within a range of 0.25λ to 0.35λ. This range of inter column spacing is desirable for the purpose of grating lobe reduction/suppression in the far field according to the present invention. In this depicted embodiment, the width of the narrower B dimension is about 43 centimeters; while the width of the wider A dimension is about 86 centimeters.

Figure 2:
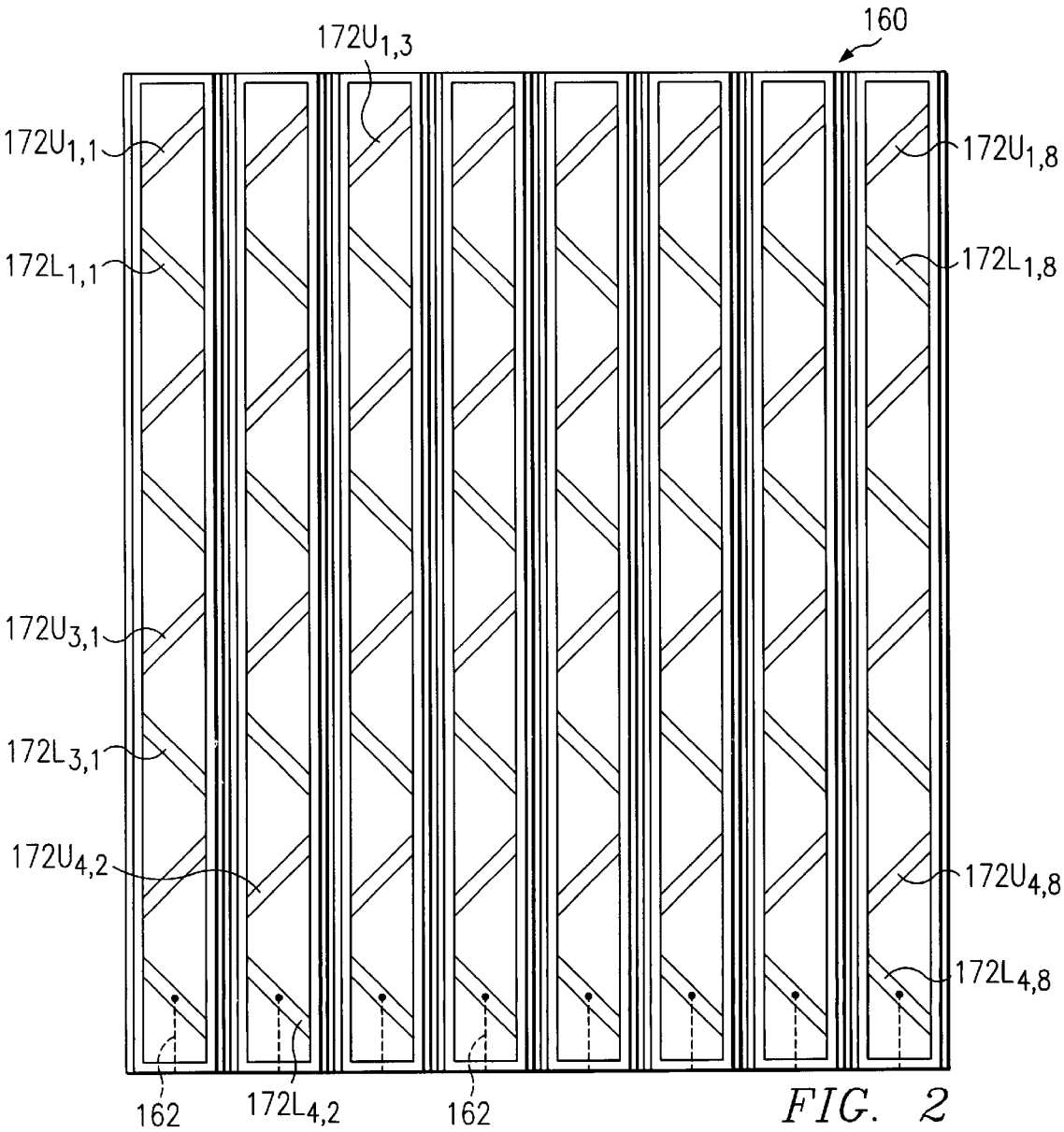
FIG. 2 shows an array of cavity slot elements in a preferred embodiment cavity slot antenna of the present invention.

With reference to FIG. 2, each slot pair element 172 of the preferred embodiment comprises an upper slot 172U and a lower slot 172L. With each of the depicted eight columns having four slot pair elements 172, there are 32 depicted upper slots $\mathbf{172}U_{1,1}$ through $\mathbf{172}U_{4,8}$ and 32 lower slots, $\mathbf{172}L_{1,1}$ through $\mathbf{172}L_{4,8}$. Of course, different numbers of slots and/or columns may be utilized according to the present invention, such as to provide desired antenna beam characteristics as is described in more detail in the above referenced related patent application entitled Dual Mode Switched Beam Antenna.

Figure 3A:
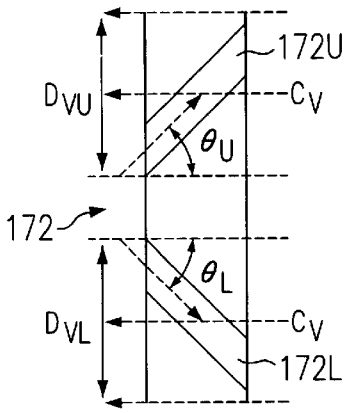
FIGS. 3A and 3B shows one embodiment of a cavity slot pair antenna element of the present invention.
Figure 3B:
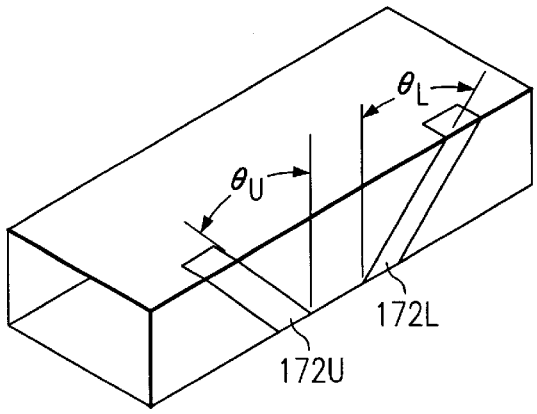

With reference to FIGS. 3A and 3B, each slot 172U, 172L, has a vertical center line $C_v$. This center line $C_v$ is perpendicular to the waveguide's wider A surface and is halfway between the vertical distance of the slot. Thus, the center line $C_v$ for an upper slot 172U is halfway between its vertical distance $D_{VU}$, and the center line for a lower slot 172L is halfway between its vertical distance $D_{VL}$.

Each of the depicted slots of the illustrated embodiment is generally longitudinal and has an associated angular displacement θ from a horizontal axis along the narrower A surface. In the case of an upper slot 172U, it has an angular displacement $\theta_U$, and in the case of a lower slot 172U, it has a displacement angle $\theta_L$. In the depicted embodiment, the upper displacement angle, $\theta_U$, is substantially 45 degrees upward from a horizontal axis, and the lower displacement angle is substantially 45 degrees downward from a horizontal axis. The upper and lower slots are also symmetrical to one another about the horizontal axis that is disposed midway between them. However, persons of ordinary skill should recognize that antenna elements are not limited to such depicted slot pairs. For example, the displacement angles could be of any desired magnitude. In addition, they may or may not be equal to one another; although, in the preferred embodiment, they are equal to and symmetrical with one another. In fact, as will be addressed in greater detail below, selected slot pair elements 172 from different columns (e.g, outer columns) may have different displacement angles from other slot pairs in the array 160. Moreover, a cavity slot element may be formed from any suitable number of slots including from a single slot.

The angle (θ) the slot takes to a line drawn perpendicular to the longitudinal axis of the wave-guide ($c_v$) determines the amount of coupling of the intensity of a radiation leaving the slot. The TE10 mode for example, would have minimum coupling at 0 degrees and more for larger angles as the slot perturbed more and more current lines as the angle increased. Accordingly, embodiment of the present invention may utilize a method of aperture tapering along the length of the column for elevation tapering and/or, if different inclination angles are used along a "slot row", a method of azimuthal tapering can be imposed. The prudent uses of various slot angles up, down, and across the array face will allow for traditional methods of side lode level control, independent of the grating lobe suppression described above.

Figure 4A:
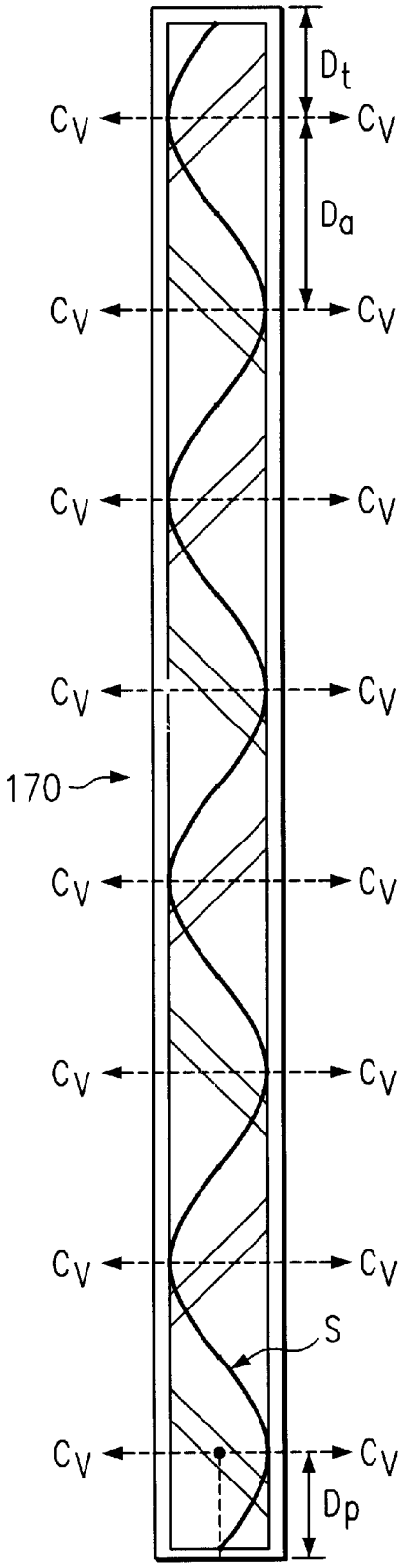
FIG. 4A shows a radiating signal propagating in a cavity slot column of the present invention.
Figure 4B:
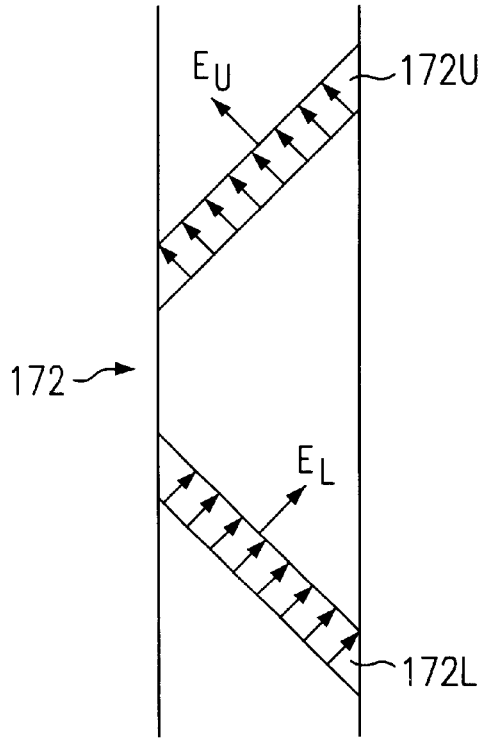
FIG. 4B shows a cavity slot pair antenna element from the column of FIG. 4A.
Figure 4C:
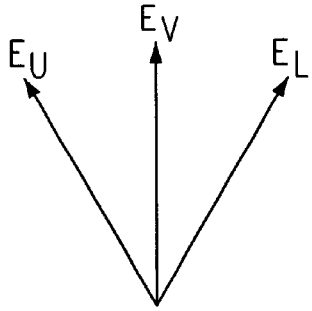
FIG. 4C diagrammatically shows in vector form how vertically polarized beam components are emitted from the cavity slot pair antenna element of FIG. 4B.

FIGS. 4A through 4C show how beam energy is radiated out of the cavity slot antenna elements 172 when the antenna array 150 is transmitting an antenna signal. (It should be recognized by persons of ordinary skill that the cavity slot columns operate substantially the same only in reverse when the antenna array 150 is acting as a receiver.) As shown in FIG. 4A, a radiating antenna signal, S, is provided to a cavity slot column 170 from probe 162. In one embodiment, in order to radiate an optimal amount of beam energy from the slot elements 172, the slots are distributed so that their vertical center lines are coincident with the peaks of signal S. This corresponds to the distances, $D_a$, between center lines of adjacent slots being substantially equivalent to one-half of a wave length of the signal S.

In addition, with the depicted embodiment, the cavity slot column 170 is configured as a standing wave antenna, which causes signal S to "bounce" back from a reflecting surface at the distal column end away from the probe in a constructive, additive manner. In accordance with this standing wave mode, the distance, $D_t$, between the uppermost slot's center line and the reflecting surface at the top of the column is substantially one-fourth of a wave length—as is the distance, $D_p$, between the lower most slot's center line and the probe 162. However, it should be recognized that the cavity slot columns of the present invention may also operate in traveling wave mode. In this mode, the upper ends of the columns would include absorbers (rather than reflectors) for absorbing the radiating signals. It should also be recognized that while a column is presented with a signal S being input at the lower end of the column and propagating upwardly, radiated signals could readily propagate downwardly with the probes being positioned at the upper ends or with a probe disposed more toward the middle of the column to cause the signal internal thereto to radiate both upward and downward. However, in systems such as cellular telephony base transcriber stations, placing the probe at a lowest point in the antenna column may be preferred in order to provide electrical downtilt of the antenna beam as discussed in more detail in the above referenced related patent application entitled System and Method for Per Beam Elevation Scanning.

FIG. 4B graphically shows how radiated energy from signal S is transmitted out of a slot pair 172. Energy from the signal S is allowed to pass along the longitudinal axis of a slot. This is represented by the small arrows in FIG. 4B. These components add with one another to form a slot's radiated energy component. In FIG. 4B, the $E_L$ vector corresponds to a lower slot's component, and the $E_U$ vector corresponds to an upper slot's component.

FIG. 4C shows how these slot signal components combine to result in a radiated beam component E, that is vertically polarized. In turn, these vertically polarized beam components combine with one another—based on the geometry of the cavity slot array 160 and the beam forming methodology as defined within the beam forming module—to form one or more vertically polarized beams, which are emitted from antenna 150. It should be recognized, however, that while such vertical polarization is generally desirable in many wireless applications, the present invention is not so limited. Other types of polarization (e.g., circular, horizontal, slant left, slant right) may readily be implemented with the present invention.

As may be seen from FIGS. 4B and 4C, a design trade-off exists in selecting the slots' angular displacements. On the one hand, more overall signal energy is allowed to pass by a slot when its angle is small. That is, when the slot approaches being horizontal. On the other hand, the resulting vertically polarized beam component E, increases as a slot's angle increases. This is because a greater portion of the slot components' ($E_U$, $E_L$) are vertical .

As taught in the afore mentioned application entitled Dual Mode Switched Beam Antenna, it is highly desirable according to some antenna designs to be able to have relatively small inter-column spacing, i.e., distances between adjacent antenna element columns. Such an arrangement in combination with a proper antenna feed network can reduce problematic grating and side lobe generation. These and other results and effects can readily and efficiently be achieved with a cavity slot antenna of the present invention. For example, the preferred embodiment cavity slot array is ideal in reducing inter-column spacing. By using the narrow sides of rectangular waveguides (cavity slot columns) for providing the slots, the slot pairs (antenna elements) in adjacent columns may be closely spaced to one another. In fact, in the depicted embodiment, adjacent slot pairs in a given row are only a slight distance apart from one another.

Figure 5A:
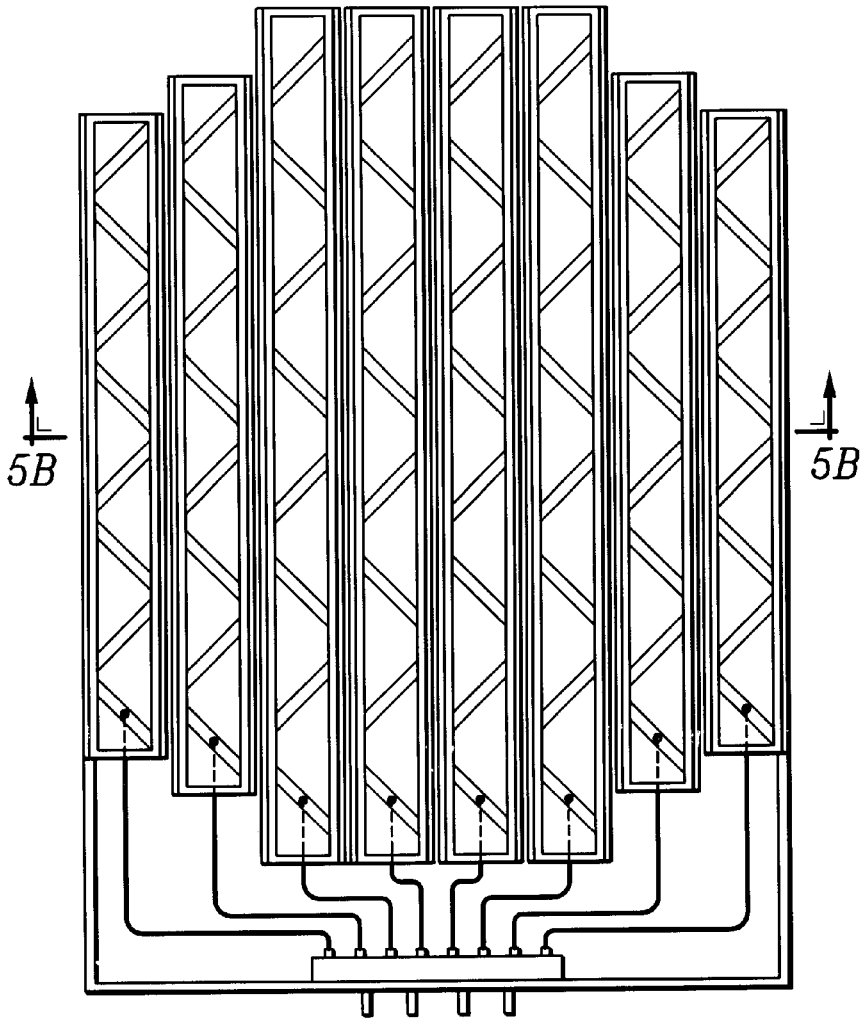
FIGS. 5A and 5B show an alternative embodiment of a cavity slot antenna of the present invention.
Figure 5B:
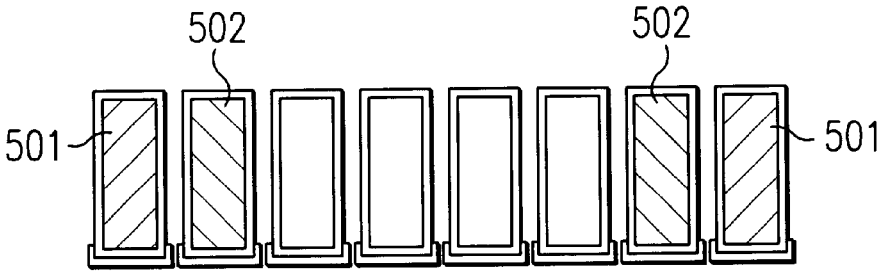

It is also desirable according to some antenna designs to be able to, in effect, vertically compress the distances between antenna elements in the outer columns such as through the use of dielectric material disposed in the waveguide of the cavity slot column. For example, directing attention to FIGS. 5A and 5B, an alternative embodiment cavity slot antenna having dielectric material 501 and 502 disposed in the outer radiator columns to retard the rate of signal propagation for tapering is shown. Specifically, dielectric material 501 has a higher dielectric constant than that of dielectric material 502 and thus the embodiment of FIGS. 5A and 5B provides a stepped tapering arrangement. This can result in antenna aperture tapering, which is also beneficial for improving beam quality when beams are being steered off the broadside.

Figure 6B:
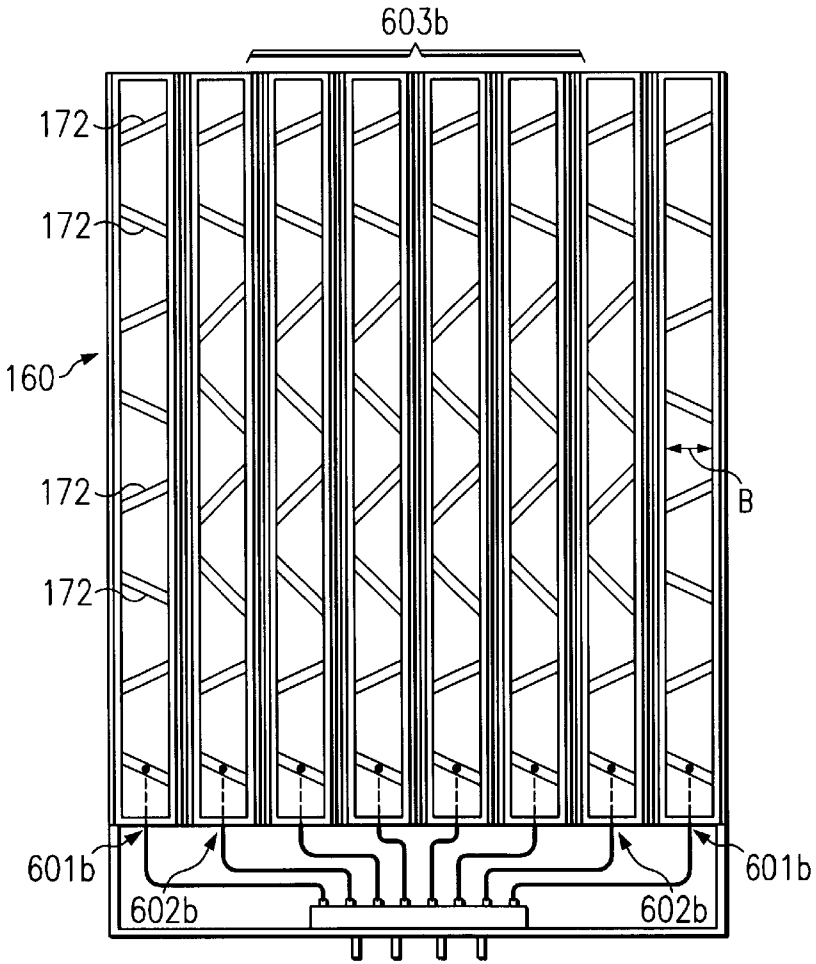
FIGS. 6A and 6B shows an alternative embodiments of a cavity slot antenna of the present invention.
Figure 6A:
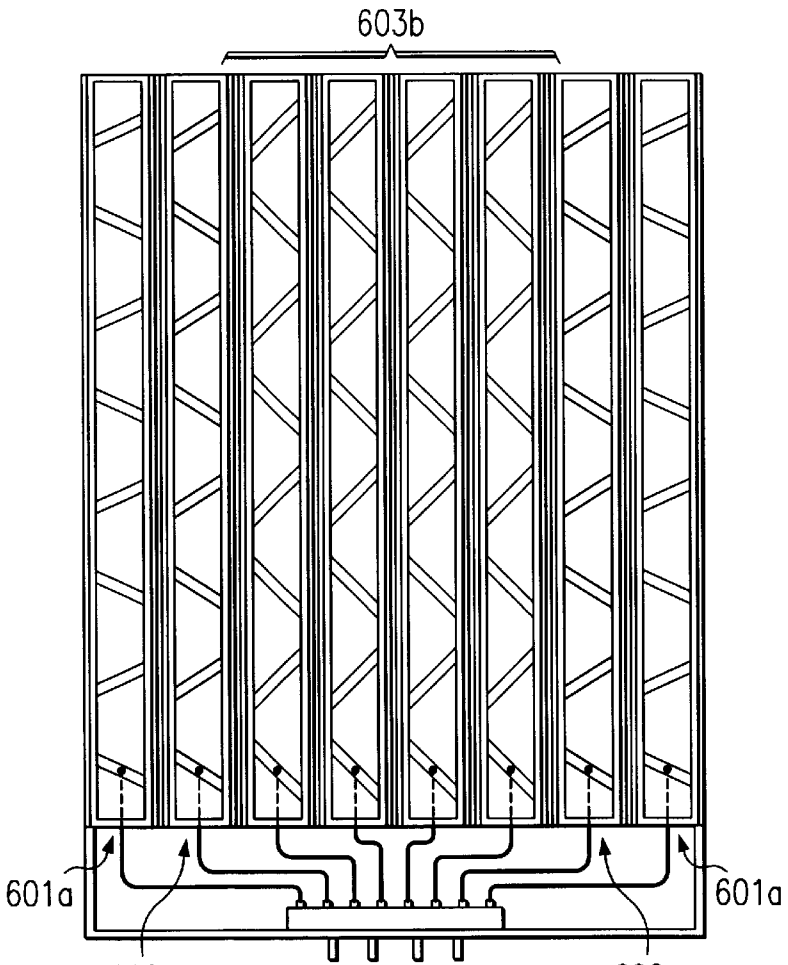
Figure 7:
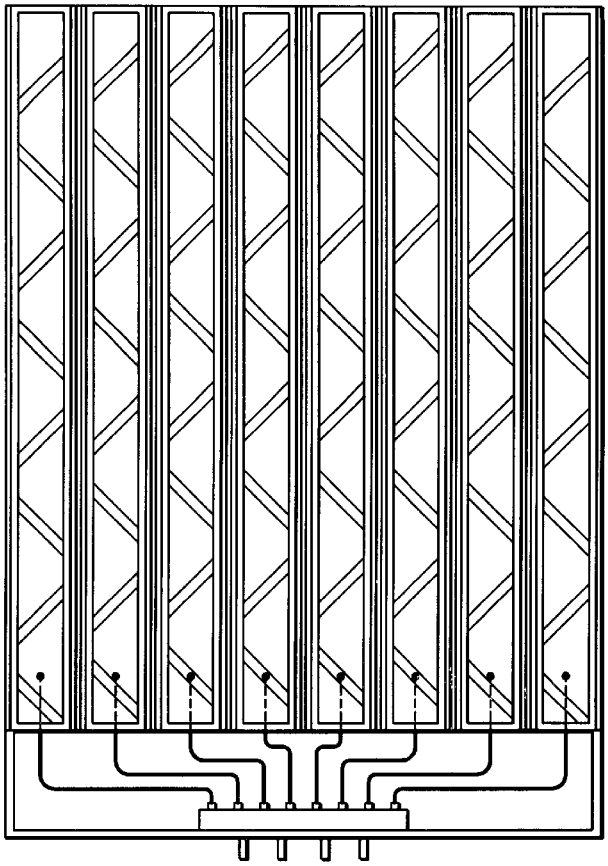
FIG. 7 shows an alternative embodiment of a cavity slot antenna of the present invention.

In addition, tapering can be achieved in various ways. For example, with the outer columns, the slots' angular displacements can be increased or decreased (as compared with typical values) in order to reduce their beam components. As shown in FIGS. 6A and 6B, tapering may be achieved by decreasing the vertical angle of the slots and thereby reducing the energy radiated by these elements. Specifically, in FIG. 6A the slot angles of columns 602*a* are slightly more horizontal, such as on the order of 5 degrees, than the center columns 603*a* and the slot angles of columns 601*a* are slightly more vertical, such as on the order of 5 degrees, than columns 602*a* to provide azimuthal tapering. This could additionally or alternatively be achieved in various other ways, such as by displacing their slot pair center lines away from the signal peaks as shown in FIG. 7. Of course, combinations of these techniques may be utilized, if desired.

FIG. 6B shows an embodiment where aperture tapering is provided in both the azimuth and in the elevation. Specifically, the slot angles of columns 602*b* are slightly more horizontal than the center columns 603*b* and the slot angles of columns 601*b* are slightly more horizontal than columns 602*b* to provide azimuthal tapering. Moreover, the slot angles disposed at the distal ends of the columns are slightly more horizontal than the slot angles disposed in the middle of the columns to provide elevation tapering. It should be appreciated that the embodiments shown are merely exemplary of the use of varied slot angles according to the present invention. For example, antennas of the present invention may have slots tapered in an asymmetrical pattern rather than being provided in the symmetry of the illustrated embodiments. Additionally or alternatively, there may be more or fewer iterations of slot angle changes throughout the antenna and/or its columns, if desired.

Another highly beneficial aspect of the present invention is that once a satisfactory slot array configuration has been achieved (via computer modeling, field testing, etc.), a cavity slot array with the desired configuration can be easily manufactured and replicated. For example, in one embodiment, a cavity slot array can be efficiently manufactured in the following manner. A back panel with perpendicularly disposed side panels (for defining the wider A surfaces of the waveguide columns) can be formed through conventional extrusion methods. A separate front panel could then be used to not only provide the slots (which could be cut out therefrom such as by a machine punching step), but also, to provide a top portion, which could result from bending over an extended tab at the upper portion of the panel. The panel could then be conventionally adhered to the extruded portion. Of course, as recognized by skilled persons in the art, countless other ways exist for efficiently and effectively making a suitable cavity slot array, and thus, the invention shall not be limited to any one particular way. For example, the individual antenna column "pipes" could be cut to length and an appropriate machining technique used to cut the desired slots in the appropriate position and orientations, such as by using a mechanized process to provide consistent replication of the desired configuration. Thereafter these antenna columns may be disposed in a proper orientation, such as upon a common back plane substrate to provide a unitary structure.

Connection of such an array to the feed network would then require only a simple disposition of a transducer, such as a microstrip line or probe, in each of the columns and its connection to the feed network. Accordingly, an antenna array providing precise beam forming, both in the vertical and in the horizontal may be easily coupled to a feed network.

Figure 8:
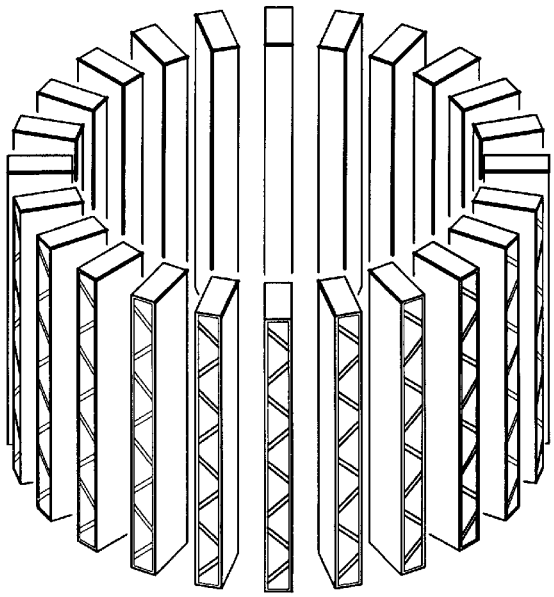
FIG. 8 shows an alternative embodiment of a cavity slot antenna of the present invention.

Although a preferred embodiment antenna array has been described with reference to a planar disposition of antenna columns, the present invention may be utilized in a variety of configurations. For example, the present invention may be utilized in providing the conical antenna structures disclosed in the above referenced related patent application entitled "System and Method for Per Beam Elevation Scanning," such as illustrated in FIG. 8. Moreover, as the waveguides of the antenna columns may be bent or otherwise shaped, the antenna configurations which may be achieved according to the present invention are virtually unlimited.

Although the present invention and its advantages have been described in detail, it should be understood that various changes, substitutions and alterations can be made herein without departing from the spirit and scope of the invention as defined by the appended claims.

What is claimed is:

1. An antenna array for communicating a signal in one or more directional antenna beams in a communication system, comprising:

an antenna array adapted to be operatively connected to a beam forming module, the antenna array having:

one or more waveguide columns disposed in a predetermined adjacent position with respect to one another, each of the one or more columns having at least one cavity slot pair disposed therein to define an antenna element for providing a beam component, the columns further having upper and lower ends; and a radiating signal probe operably disposed in each column proximal to its lower end for emitting a signal that propagates toward its upper end, wherein at least one of the one or more columns has a reflecting surface at its upper end for reflecting the signal to enable the column to function in a standing wave mode;

wherein the at least one slot antenna elements from the one or more columns define a cavity slot array for providing the one or more beams from the beam components and wherein the cavity slot elements in a substantially common row and from adjacent columns are sufficiently proximal to one another to enable a substantially steered beam with sufficiently minimal grating to be produced.

2. The antenna array of claim 1, wherein array is substantially non-planar.

3. The antenna array of claim 2, wherein the substantially non-planar array is curvalinear.

4. The antenna array of claim 1, wherein the array is substantially planer.

5. The antenna array of claim 4, wherein the cavity slot columns comprise vertically disposed, rectangular waveguides each having a wide surface component and a front, narrow surface component that includes the at least one cavity slot.

6. The antenna array of claim 1, wherein the cavity slot pair includes upper and lower slots, each slot having an associated angular displacement.

7. The antenna array of claim 6, wherein the angular displacements from the upper and lower slots are substantially equivalent to one another, but in an opposite orientation.

8. The antenna array of claim 7, wherein the angular displacements are substantially equivalent to 45 degrees.

9. The antenna array of claim 1, wherein the reflecting surface is substantially one-fourth of the signal wave length in distance away from an uppermost cavity slot in its column.

10. The antenna array of claim 9, wherein the probe in each column is substantially one-fourth of the signal wave length in distance away from a lower most cavity slot in the column.

11. An antenna array for communicating a signal in one or more directional antenna beams in a communication system, comprising:

an antenna array adapted to be operatively connected to a beam forming module, the antenna array having;

one or more waveguide columns disposed in a predetermined relative position with respect to one another, each of the one or more columns having at least one cavity slot pair disposed therein to define an antenna element for providing a beam component;

wherein the at least one slot antenna elements from the one or more columns define a cavity slot array for providing the one or more beams from the beam components and wherein the one or more columns have upper and lower ends, the antenna array having a radiating signal probe operably disposed in each column proximal to its lower end for emitting a signal that propagates toward its upper end and at least one of the one or more columns has an absorber proximally mounted at its upper end for absorbing the signal so that the column will function in a substantially traveling wave mode.

12. An antenna array for communicating a signal in one or more directional antenna beams in a communication system, comprising:

an antenna array adapted to be operatively connected to a beam forming module, the antenna array having:

one or more waveguide columns disposed in a predetermined relative position with respect to one another, each of the one or more columns having at least one cavity slot pair disposed therein to define an antenna element for providing a beam component;

wherein the at least one slot antenna elements from the one or more columns define a cavity slot array for providing the one or more beams from the beam components and wherein said one or more waveguide columns include a plurality of waveguide columns, ones of which are adapted to provide tapering of said one or more directional antenna beams.

13. The antenna array of claim 12, wherein said ones of said waveguide columns include a dielectric material to reduce spacing of antenna element slots disposed there on.

14. The antenna array of claim 12, wherein said ones of said waveguide columns include antenna element slots having a different angle of disposition than others of said waveguide column antenna element slots.

15. The antenna array of claim 12, wherein said ones of said waveguide columns include antenna element slots having a different disposition with respect to a standing wave of said waveguide columns than others of said waveguide columns.

16. A method of providing a cavity slot antenna array for a multi-beam antenna array in a communication system, the method comprising:

defining one or more operational parameters for the multi-beam antenna array;

designing a cavity slot array for implementing said multi-beam antenna array, the cavity slot array having a plurality of cavity slot antenna elements;

testing the designed cavity slot array to determine whether it satisfies said operational parameters;

modifying the design including modifying at least one of the cavity slot elements in response to said testing until the cavity slot array satisfies the operational parameters; and manufacturing a plurality of cavity slot arrays incorporating the satisfactory design.

17. The method of claim 16, wherein manufacturing includes creating a cavity slot pattern in conformance with the satisfactory cavity slot configuration and cutting the cavity slots for each of the plurality of arrays with said pattern.

18. The method of claim 17, wherein each of said arrays is formed by extruding a first array portion that includes rearward and side panels, making a front panel that includes the cavity slots, which are cut from the pattern, and adhering said front panel to said first portion.

* * * * *